US005599208A

United States Patent [19]

Ward

[11] Patent Number: 5,599,208

[45] Date of Patent: Feb. 4, 1997

[54] ELECTRICAL CONNECTOR WITH PRINTED CIRCUIT BOARD PROGRAMMABLE FILTER

[75] Inventor: Bobby G. Ward, King, N.C.

[73] Assignee: The Whitaker Corporation, Wilmington, Del.

[21] Appl. No.: 355,767

[22] Filed: Dec. 14, 1994

[51] Int. Cl.[6] ..... H01R 13/66

[52] U.S. Cl. ..... 439/620; 333/185

[58] Field of Search ..... 439/620, 276; 333/184, 185

[56] References Cited

U.S. PATENT DOCUMENTS

| | | | |
|---|---|---|---|
| 4,020,430 | 4/1977 | Vander Heyden | 333/79 |
| 4,473,755 | 9/1984 | Imai et al. | 307/10 R |
| 4,600,256 | 7/1986 | Anttila | 339/17 M |
| 4,653,838 | 3/1987 | Ney et al. | 333/185 |
| 4,660,907 | 4/1987 | Belter | 339/14 R |
| 4,673,237 | 6/1987 | Wadsworth | 439/607 |
| 4,682,129 | 6/1987 | Bakerman et al. | 333/184 |
| 4,726,638 | 2/1988 | Ferrar et al. | 439/620 R |
| 4,726,790 | 2/1988 | Hadjis | 439/620 |
| 4,729,743 | 3/1988 | Farrar et al. | 439/276 |
| 4,729,752 | 3/1988 | Dawson, Jr. et al. | 439/620 |
| 4,930,200 | 6/1990 | Brush, Jr. et al. | 29/25.42 |
| 4,931,754 | 6/1990 | Moussie | 333/184 |
| 4,959,626 | 9/1990 | Moussie | 333/182 |
| 5,082,457 | 1/1992 | Wollscheidt | 439/620 |
| 5,141,455 | 8/1992 | Ponn | 439/620 |
| 5,150,086 | 9/1992 | Ito | 333/182 |
| 5,152,699 | 10/1992 | Pfeifer | 439/620 |
| 5,153,540 | 10/1992 | Gliha et al. | 333/182 |
| 5,219,305 | 6/1993 | Kawaguchi et al. | 439/620 |
| 5,344,342 | 9/1994 | Briones | 439/620 |

*Primary Examiner*—Neil Abrams
*Assistant Examiner*—Eugene G. Byrd
*Attorney, Agent, or Firm*—Timothy J. Aberle

[57] ABSTRACT

An apparatus and method for filtering and grounding individual electrical circuits in an electrical connector is disclosed. The electrical connector is based on standard configurations, such as a printed circuit board header 10 having a standard footprint. A filtering subassembly includes a programmable filter printed circuit board 16 to which surface mount components 56, 66 are soldered. Printed circuit board terminals, such as right angle printed circuit board pins 14 are inserted in plated through holes 38 and electrical connection is established intermediate the ends of the terminals. A solderless compliant pin section 30 can be used. Capacitors 56 can be selectively used to filter certain individual circuits or lines and zero value resistors 66 can be used to ground other lines. These surface mount components are preferable loaded using programmable pick and place equipment and are soldered between pin surface mount pads 44 and adjacent grounded surface mount pads 46. The grounded pads are commoned to a shield layer 52 on one side of the printed circuit board and a peripheral ground strip 40 on the other side so that the board can be mounted in two opposite orientations.

8 Claims, 5 Drawing Sheets

Fig. 3
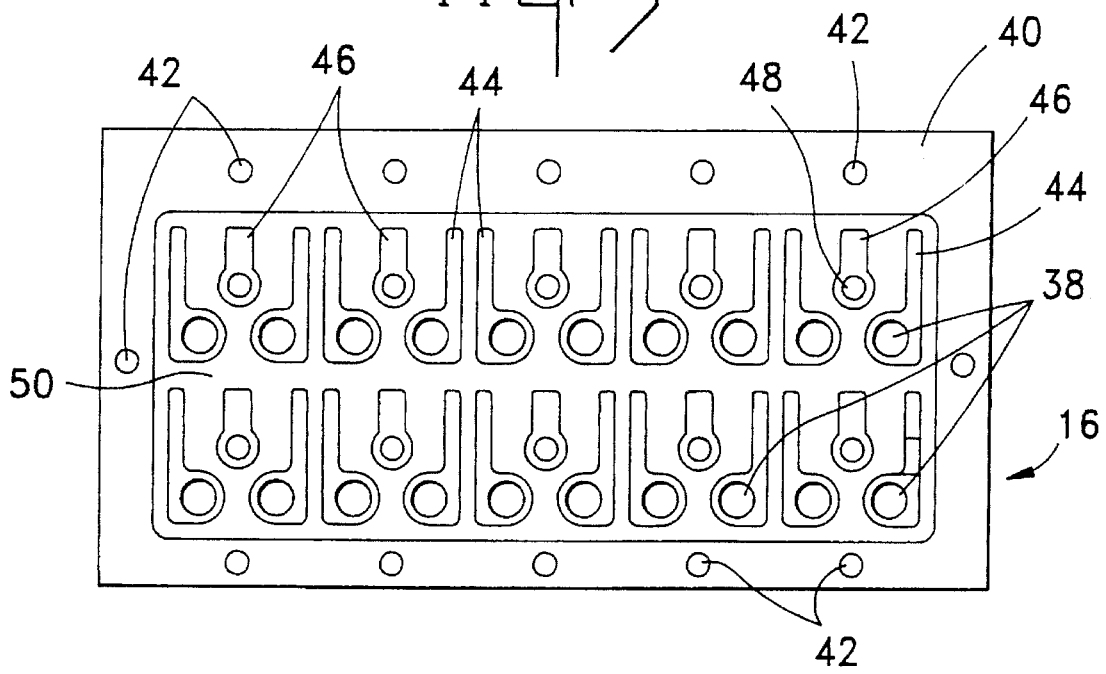
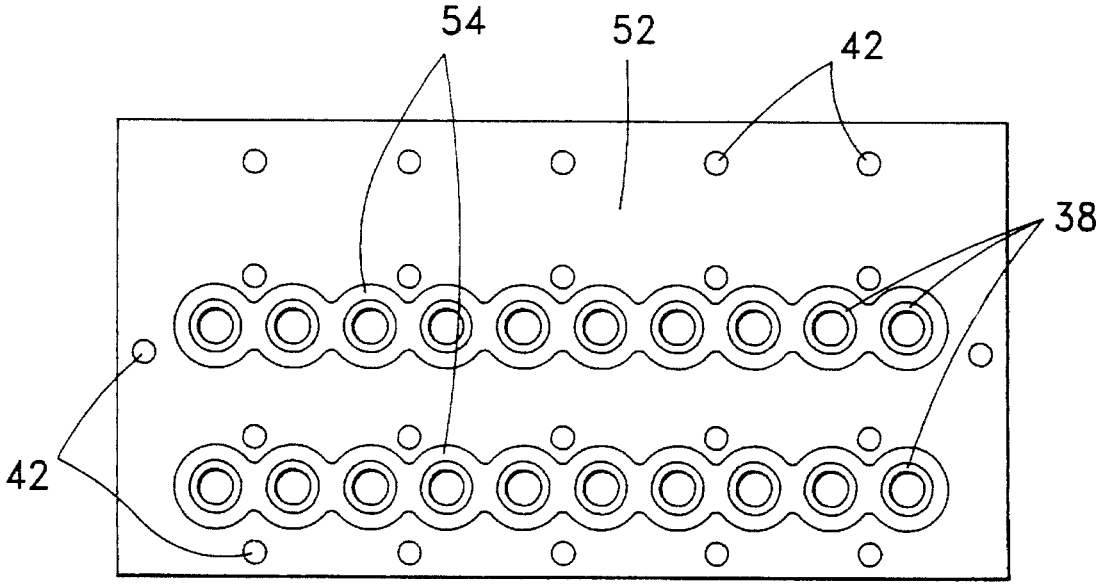
Fig. 4

ELECTRICAL CONNECTOR WITH PRINTED CIRCUIT BOARD PROGRAMMABLE FILTER

BACKGROUND OF THE INVENTION

1. Field of the Invention

This invention relates to electrical connectors and more specifically to filtered electrical connectors. This invention relates to a configuration and a manufacturing method for using common parts to fabricate multiple filtered and shielded connector configurations.

2. Description of the Prior Art

Electrical connectors employing filtering elements are commonly used to filter electromagnetic interference and radio frequency interference in circuits used in noisy environments. Filter connectors are also used to prevent unwanted emissions from noisy circuits. One common method for including filtering in electrical connectors is to mount an auxiliary printed circuit board subassembly including capacitors and other filtering components on the connector. These auxiliary printed circuit boards are designed for the specific filtering application. Inductive filtering is commonly provided by employing ferrite beads. Ferrites in the form of plates with holes to receive an array of pins are also commercially available.

Typically these filter subassemblies are incorporated either in new electrical connectors especially designed for the specific applications or in conventional connectors especially modified for filtering applications. This is especially true in automotive applications. However, not all applications have the same filtering requirements, thus limiting the economic advantage that can otherwise be realized by using standard commercially available connectors. Even in applications in which standard connectors are used, it has been common practice to provide filtering for all lines, even where noise is only a problem on certain lines. Subassemblies that add filtering to all lines are also inconsistent with applications in which some lines or individual circuits are ground rather than signal lines. The instant invention provides modular or programmable components that can be used with standard connector configurations and footprints for different applications which have different filtering requirements and different signal—ground configurations.

SUMMARY OF THE INVENTION

A filtered electrical connector, preferably but not necessarily in the form of a printed circuit board header connector, includes a programmable filtering subassembly, using standard components, which can be especially configured for different applications. The same basic connector can be used for all of these applications. The filtering subassembly includes a filter printed circuit board which is designed to be used with a conventional electrical connector. An electrical connection is made with terminals, such as pins, with plated through holes in the filter printed circuit board. A compliant pin section intermediate the ends of the terminals can be used or the pin can be soldered in the plated through holes. Standard surface mount components, such as EIA standard 0805 capacitors, are then soldered between surface mount pads associated with the plated through holes and grounded surface mount pads. Although all plated through holes are provided with associated surface mount pads, components are soldered only at locations where filtering is desired. For pins which are to be grounded, zero value surface mount resistors are soldered instead of capacitors. Conventional assembly techniques and equipment, such as pick and place assembly machines, can be used to configure or program standard filter printed circuit boards for use with standard electrical connectors for different applications dictated by the circuitry in which this programmable filtered electrical connector is used.

This invention provides a standard economical approach which can be used with a wide variety of different circuits. Furthermore this invention provides an economical approach since only standard components, including a standard printed circuit board are used. For each pin count connector, only one printed circuit board is necessary. Only standard assembly operations, such as pick and place assembly and conventional surface mount soldering, are needed. This invention is also compatible with the use of solderless compliant pins to establish electrical connections with each terminal. Common footprints for conventional connectors can be used.

This invention is compatible with just in time inventory, and it permits the user to specifically tailor the design to his own needs with a rapid turn around. For example, an end user can quickly and economically solve an unexpected noise problem by simply reprogramming pick and place assembly equipment to add only those filter components which are necessary. This invention is applicable to both low and high volume production runs and does not require new tooling for each application. The invention is also compatible with circuits that include ground pins in addition to filtered individual circuits. It can be used in applications which require shielding as well. These and other objects are achieved by this invention which is herein disclosed in two of its many possible representative embodiments.

BRIEF DESCRIPTION OF THE DRAWINGS

FIG. 3 is a view of the solder side of a printed circuit board on which surface mount components can be positioned to filter one or more of the lines or individual circuits connected by the header connector in which this printed circuit board is mounted.

FIG. 4 is a view of the shield side of the printed circuit board shown in FIG. 3. The shield side is on the opposite side of the printed circuit board from the solder side.

DETAILED DESCRIPTION OF THE PREFERRED EMBODIMENTS

Figure 1:
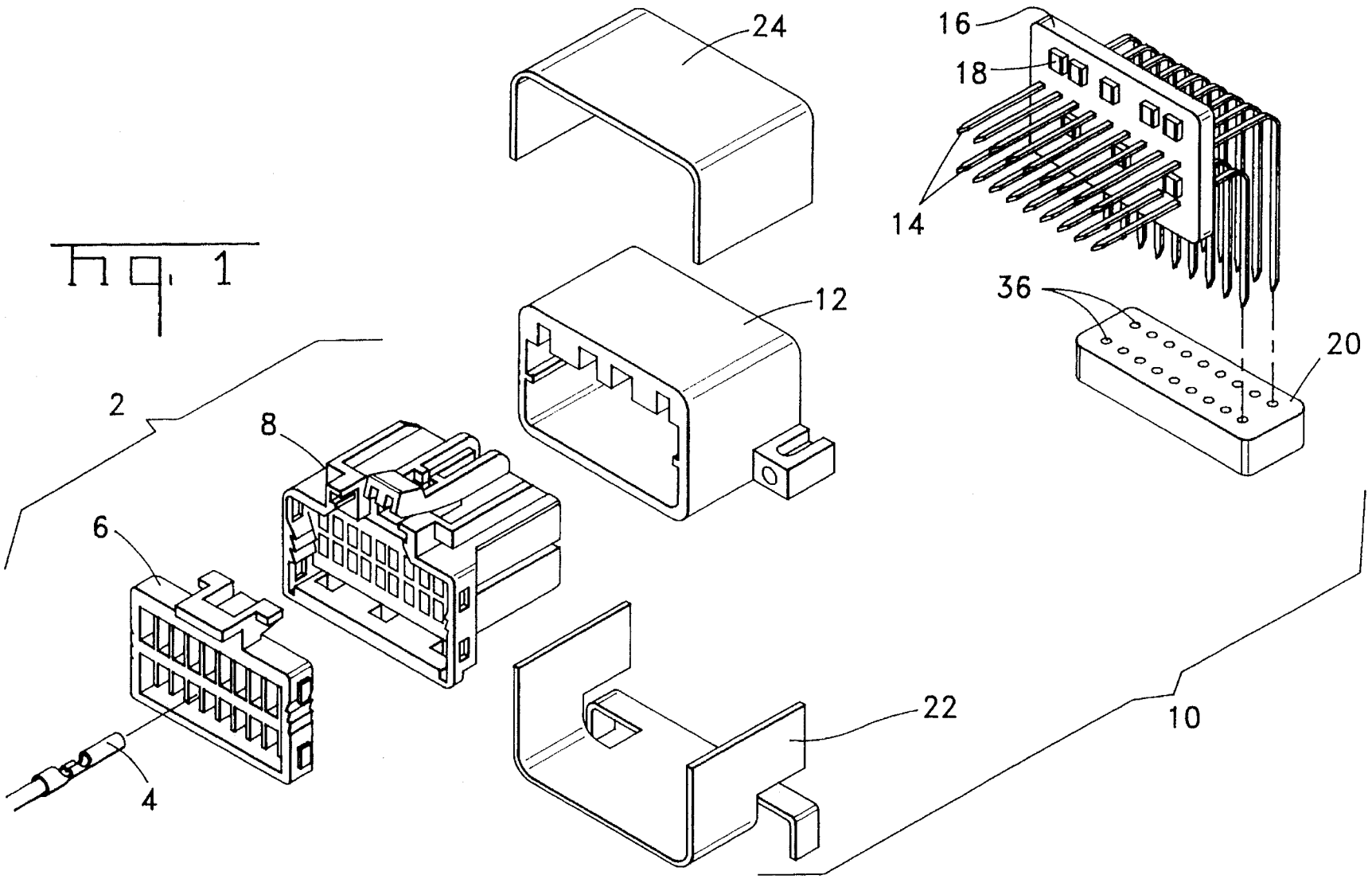
FIG. 1 is an exploded perspective view of an electrical connector assembly including mating plug and header connectors in which a header subassembly includes a printed circuit board containing surface mount components which can be manufactured in a number of different filtered configurations.

FIG. 1 shows an electrical connector plug 2 which is mated with a printed circuit board header 10 to connect a plurality of wires to a printed circuit board (not shown). The connector plug 2 and the basic configuration of the header 10 are conventional, but the header 10 contains additional components for providing both filtering and shielding for this basic connector configuration. The representative embodiment of the mating connector halves shown in FIG. 1 is the MULTILOCK electrical connector manufactured and sold by AMP Incorporated. MULTILOCK is a trademark of The Whitaker Corporation. This conventional connector configuration is shown to demonstrate that the programmable filtering of the instant invention is intended to be employed with electrical connector configurations which are commonly used in an unshielded and unfiltered configuration. This specific electrical connector configuration is intended, however, to be only representative since the programmable filtering of this invention can be applied to other conventional configurations.

The electrical connector plug 2, shown in FIG. 1, is a twenty-position electrical connector in which adjacent lines or terminals are positioned on centerlines spaced apart by 2.5 mm (0.098 in.). This connector has two rows of terminals, and terminals in both rows are located in an unstaggered configuration. A single female or receptacle terminal 4 is shown in FIG. 1. This terminal is crimped to a wire and then positioned within a multicavity plug housing 8 to which a terminal retention cap 6 is secured. Each terminal has a female mating portion of conventional construction which is located within housing 8 in position to mate with pins in a mating connector, such as pins 14 in mating header connector 10.

The mating header 10 uses a housing 12 of a conventional insulative material. The header housing 12 has openings in the rear through which pins 14 extend. The pins 14 in the preferred embodiment are right angle pins with one end being oriented to establish electrical contact with the female or receptacle terminals 4 located in the mating connector 2. The opposite end of these pins 14 are positioned so that they can be inserted into a printed circuit board to which the header 10 is to be attached. This printed circuit board is not shown in FIG. 1. The header 10 shown in FIG. 1 is a right angle printed circuit board header using right angle pins. It should be understood that other embodiments could be employed, including a header using straight printed circuit board pins.

A programmable filter printed circuit board 16 having surface mount components 18 is shown in FIG. 1. The pins 14 extend through this printed circuit board 16 and electrical contact is established between surface mount components 18 on this programmable printed circuit board and the corresponding pins 14. The components 18 can be surface mount capacitors that can be used to filter noise on the lines or individual circuits represented by pins 14. FIG. 1 also shows a ferrite noise suppression plate 20 which can be inserted onto the array of pins 14 to provide inductive filtering. Holes 36 in the ferrite plate 20 are located in an array to match the position of the pins 14. The ferrite suppression plate 20 would be eliminated for applications which do not require inductive filtering.

The preferred embodiment of the header connector 10 is both a filtered and a shielded connector. A lower shield 22 fits on the exterior of the housing 12 and an upper shield 24 is located on the top of the housing 12. The lower shield includes tabs which can be soldered to ground traces on the printed circuit board to which this header 10 is connected. The shields 22 and 24 can be soldered together. The shields can also be soldered to a ground surface on the programmable filter printed circuit board 16 as will be discussed subsequently in greater detail. Although the shields in the preferred embodiment are soldered to ground traces on the printed circuit board and are soldered together, it should be understood that other means of attaching the shields to each other or to the printed circuit board could be employed. For example a resilient solderless connection could be employed. It should also be understood that two separate shields are not necessary and a single piece shield could be employed.

Figure 2:
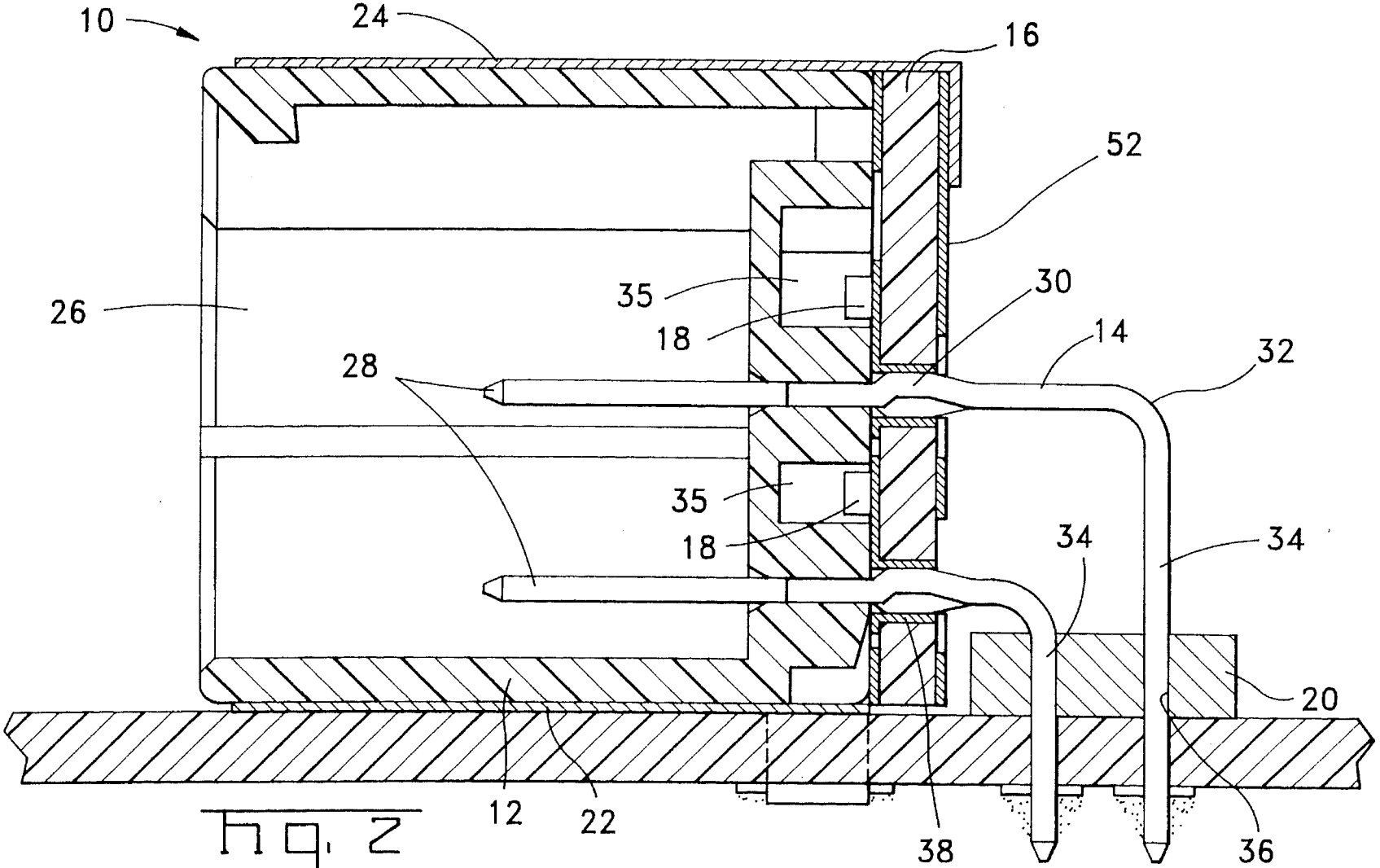
FIG. 2 is a section view of a shielded electrical connector in the form of a printed circuit board header showing the position of a filter array which includes surface mount capacitors mounted on a printed circuit board.

The sectional view of FIG. 2 shows the assembled header 10 and the relative positions of the housing 12, the pins 14, and the shields 22 and 24. The header 10 is shown mounted on a printed circuit board along the lower face of the header housing 12. FIG. 2 also shows the position of the filter components including the programmable filter subassembly, which in turn includes the printed circuit board 16 and the surface mount components 18, and the ferrite noise suppression plate 20.

Pins 14, having a compliant section 30, are shown in the header 10 of FIG. 2. This compliant section establishes a press fit electrical interconnection with the plated through holes 38 on the filter printed circuit board 16. The plated through holes 38 comprise a cylindrical conductive surface along which electrical contact can be established with the compliant pins section 30. The compliant section 30 shown in this embodiment is a conventional compliant section, which establishes and maintains a resilient mechanical and electrical connection with the plated through holes 38. Pins of this type are commonly used for establishing a solderless electrical connection with printed circuit board traces. The section 30 depicted herein is a split beam compliant section of the type manufactured and sold as an ACTION PIN contact by AMP Incorporated. ACTION PIN is a trademark of The Whitaker Corporation. Other conventional compliant pin sections could be also be employed. Pins 14 could also be soldered in plated through holes 38 using any of several conventional soldering techniques, such as wave soldering, IR or laser reflow soldering. These soldering operations do however require either an extra operation, or the soldering process must be compatible with the surface mount solder application of the surface mount components 18 to the same printed circuit board 16.

The compliant pin section 30 on pins 14 is located between the forward contact portion 28, which is located within a mating cavity 26 of housing 12, and the right angle bend in terminal pin 14. The opposite pin end 34 of each of the pins in the array, shown in FIGS. 1 and 2, is located in a position in which that end can be inserted into and soldered to holes on printed circuit board to which the header 10 is mounted. In the embodiment of FIG. 2, the pins 14 are inserted through holes in the rear wall of the header housing 12 and then the pins in this subassembly are inserted into holes in the filter printed circuit board 16. An interference fit can be established between the pins, ahead of the compliant section 30, and the rear wall of the header housing 12. The terminal pins 14 can also be inserted into the housing and the printed circuit board as part of the same insertion operation. Alternatively, the pins 14 can be individually inserted into the housing 12 before they are inserted into the plated through holes 38 in printed circuit board 16. This alternate operation could be carried out by inserting pins 14 into the rear wall from the front. In this insertion approach, clearance would have to be provided for the compliant pin section 30 in the rear wall of the housing. This clearance is not shown in FIG. 2. For the front loaded version, the right angle bend 32 in the terminal pins 14 can be formed after the pins are positioned in the filter printed circuit board 16 and the header housing 12.

FIG. 2 shows a version of header 10 in which the printed circuit board filter subassembly is mounted on the outside of the rear wall of the housing 12 with the surface mount components 18 positioned adjacent to the housing 12. The configuration of FIG. 2 shows that two slots 35 have been formed in the header housing to provide clearance for the surface mount components 18. The lower of the two slots 35 is located between the two rows of pins 14. The upper of the two slots 35 is located above the top row of pins 14. These two slots extend for the entire length of the two rows of pins, since surface mount components 18 can be located adjacent all of the pins 14 in header 10. Of course discrete pockets could be formed on the rear of the housing in lieu of continuous slots. The additional clearance provided by the slots 35 permit the opposite ends 34 of pins 14, and consequently the plated through holes in which they are soldered, to be located closer to the body of the housing 12, to minimize the printed circuit board real estate which is occupied by the filtered header 10. For applications in which board real estate is not critical, the slots 35 could be eliminated. Alternatively, the orientation of the printed circuit board could be reversed and the components 18 could face outwardly. In the embodiment of FIG. 2, the top shield 24 is soldered to the rear face of the printed circuit board 16, which as will be subsequently discussed, has a shield layer 52 extending over substantially the entire printed circuit board. The bottom shield 22 includes tabs that can be attached, by soldering or by a press fit connection, to ground traces on the printed circuit board to which the header 10 is attached. Thus a common ground connection can be established between the shield layer 52 and electrical ground on the printed circuit board. In the alternate configuration in which the surface mount components face outwardly, this ground connection could be made through a dedicated ground pin in the array of pins 14, or the shield could be soldered to a ground strip on the component side of printed circuit board 16. In addition to reversing the orientation of the filter printed circuit board subassembly including printed circuit board 16 and components 18, this subassembly could also be mounted on the inside of the header cavity 26. Internal mounting would however not be compatible with all conventional configurations, because the length of the pin mating section 26 might be reduced beyond a critical limit. Also conventional housing configurations could also present latching problems, since the insertion depth of mating housings normally must be constant if connector latch features are to properly operate. These problems might only be encountered when the filtered printed circuit board configuration is to be used to retrofit a conventional connector configuration. This approach could always be made to function with entirely new connector configurations.

An example of a printed circuit board that can be used in a programmable filter subassembly is shown in FIGS. 3 and 4. FIG. 3 shows the component side of the printed circuit board 16, and FIG. 4 shows the opposite shield side. This printed circuit board is a conventional double sided printed circuit board with copper laminate traces and layers on opposite sides of an insulative substrate 50. A number of plated through holes 38 extend through the insulative substrate to both sides of printed circuit board 16. In the representative example of FIG. 3, there are twenty plated through holes 38 arranged in two rows with adjacent plated through holes in the two rows being located at the same distance from the edge of the printed circuit board. In other words, these plated through holes are positioned in unstaggered rows. In this embodiment the centerlines of adjacent plated through holes in each row are spaced apart by a distance of 2.5 mm (0.098 in.). The plated through holes 38 are therefore positioned to receive pins 14 in a twenty-position printed circuit board header 10. Each plated through hole 38 is associated with a surface mount contact pad 44 which extends from the corresponding through hole. The through hole and its associated surface mount contact pad comprise one continuous electrically conductive member. All of these pads 44 extend in one direction. As shown in FIG. 3 the pads 44 associated with the lower row plated through holes extend to a location between the two rows of plated through holes 38. The surface mount pads 44 associated with the top row of plated through holes extend to a location above that row and between the top row of plated through holes 38 and the upper edge of printed circuit board 16. The pads 44 are slightly offset from the centerlines of the corresponding plated through holes 38, and pads 44 associated with adjacent through holes in the same row extend from opposite sides of the plated through holes 38.

A second set of surface mount pads 46 are located on the component side of the printed circuit board 16 as shown in FIG. 3. As will be subsequently described, these surface mount pads 46 will be connected directly to a separate surface on the printed circuit board which is at ground potential. Each of these grounded surface mount pads 46 is located between two adjacent surface mount pads 44 associated with adjacent plated through holes 38 in the same plated through hole row. One row of grounded surface mount pads 46 is located between the two plated through hole rows. The second row of grounded surface mount pads 46 is located between the top row of plated through holes and the adjacent edge of the printed circuit board 16. This second row of grounded surface mount pads 46 is positioned with the individual pads between adjacent the top row of pads 44 associated with the top row of plated through holes 38. Each of the grounded surface mount pads 46 is associated or connected to a through hole or via or metallized connecting hole 48 which connects the surface mount pad 46 with the opposite side of the printed circuit board 16. As will be seen, the vias, or through holes, or thru holes, or metallized connecting holes 48 connect the pads 46 to a grounded layer on the opposite side of the printed circuit board 16.

An electrically conductive continuous ground strip 40 extends completely around the periphery of the component side of the printed circuit board 16 as shown in FIG. 3. In this embodiment of the invention, this ground strip is not directly connected on the component side of the printed circuit board to the other traces on that side of the printed circuit board. A second set of plated through holes or vias 42 are, however, positioned around the ground strip to provide multiple connection to the opposite side of the printed circuit board.

The opposite or shield side of the printed circuit board 16 of FIG. 3 is shown in FIG. 4. A conductive shield layer 52 extends over substantially all of this surface. Only a small area surrounding each row of plated through holes 38 is not part of this shield layer 52. Solder resist 54 surrounds the plated through holes 38. The shield layer 52 has been etched away from the insulative substrate in this area to electrically isolate the shield layer from the plated through holes 38. The solder resist 54 is printed in this area to prevent any solder bridges. Metallized connecting holes 42 communicating between ground strip 40 and shield layer 52 are shown in FIG. 4 as well as metallized connecting holes 48 communicating between grounded surface mount pads 46 and shield layer 52. Thus shield layer 52, ground strip 40 and grounded surface mount pads 46 are all electrically commoned. The shield layer 54 and the ground strip 40 provide a commoned electrically conductive surface on the periphery of both sides-of the printed circuit board 16. When board 16 is positioned between the upper housing shield 24 and the header housing 12, the shield can be soldered to one of these layers. The same printed circuit board can therefore be positioned either with the component side adjacent the header housing 12, as shown in FIG. 2, or with the components facing outwardly, in which case the upper housing shield 24 would be soldered directly to the ground strip 40.

Figure 5:
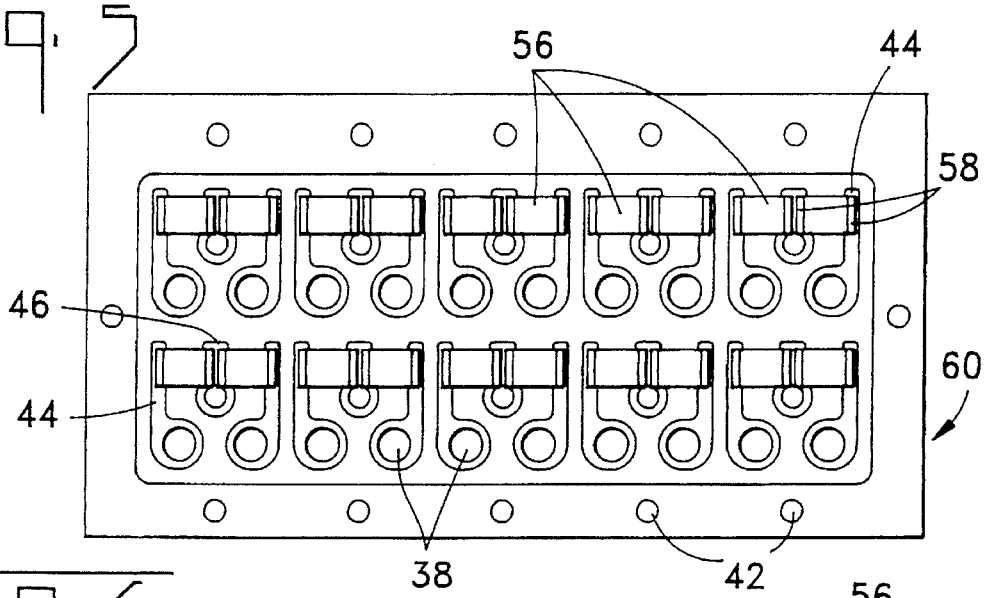
FIG. 5 is a view of a first filter configuration in which surface mount capacitors are positioned between each line and ground to provide a filter for each line.
Figure 6:
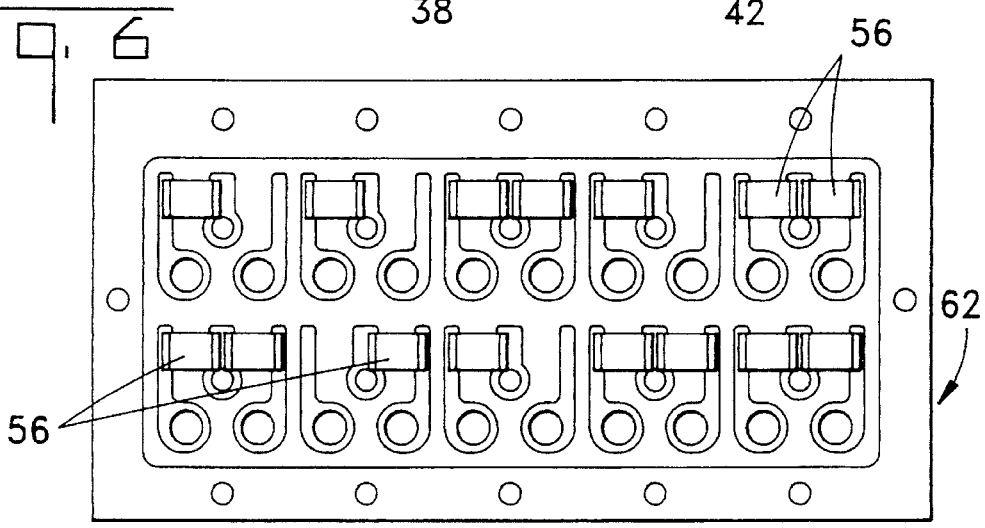
FIG. 6 is a view of a second filter configuration in which the same printed circuit board as used for the configuration of FIG. 5, but only certain lines in the connector are filtered.
Figure 7:
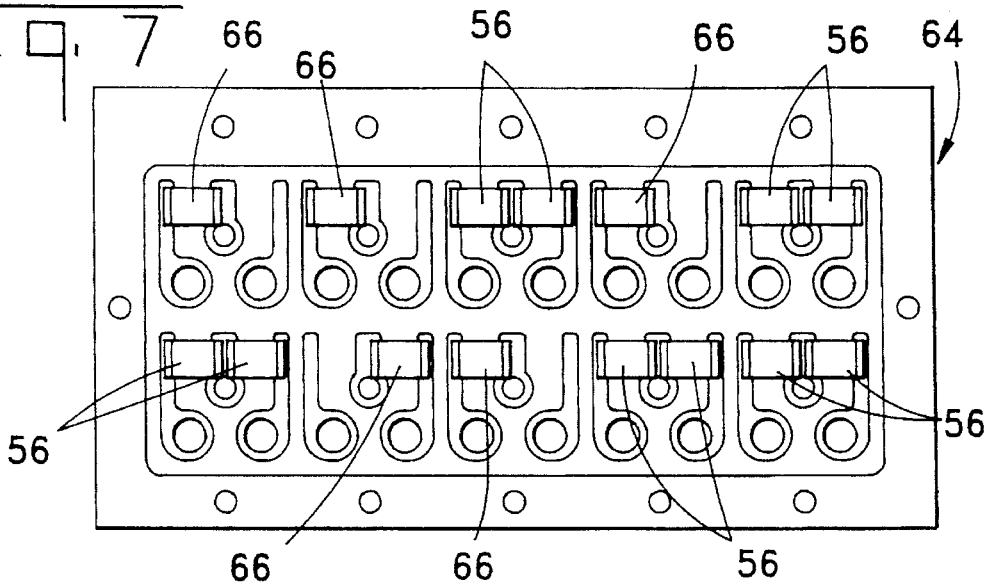
FIG. 7 is a view of a third filter configuration in which the same printed circuit board as used for the configuration of FIGS. 5 and 6, but in which some lines are filtered and in which zero value surface mount resistors are used to common selected lines to ground as required by the specific circuit in which this filtered connector configuration is used.

The printed circuit board 16 shown in FIGS. 3 and 4 is a common printed circuit board which can be used for a large number of different filter configurations for a common electrical connector, in his case the header connector 10. Three examples of different filter configurations are shown in FIGS. 5, 6 and 7. Since the same printed circuit board can be used to fill requirements for different filter configurations, the filter subassemblies and this common printed circuit board can be said to be programmable. FIG. 5 shows one common filter subassembly 60 in which each of the twenty lines in the subassembly 60 and the filtered header 10 would be filtered by using a surface mount capacitor 56. Surface mount capacitors 56 are positioned on the printed circuit board using conventional pick and place equipment or they can be positioned robotically. Any common manufacturing technique to position surface mount components can be employed. Each surface mount capacitor 56 is positioned with the metallized ends 58 aligned with adjacent surface mount pads 44, associated with a through hole 38, and grounded surface mount pads 46. Normally an adhesive would be used to initially position the surface mount capacitors 56 prior to soldering. A conventional surface mount soldering operation, such as hot air reflow, could then be used to solder the capacitors between the pads. Wave soldering could also be used prior to insertion of the compliant pins 14 in plated through holes 38. If solder paste is applied in the plated through holes, standard noncompliant pins could be used and soldered during the reflow soldering operation. In any case the various soldering operations are all conventional and numerous options are available.

The surface mount capacitors 56 employed in the preferred embodiment of this invention are standard 0805 surface mount components. The length of these standard rectangular surface mount components is 2.0 mm (0.080 in.) and their width is 1.2 mm (0.050 in.). In the preferred embodiments of this invention these standard components are positioned with their longer lengthwise dimensions extending parallel to the through hole rows so the shorter width dimension extends between the two rows. This facilitates compact spacing of the components so that they can be positioned between the pin rows located on 2.5 mm (0.098 in.). centerlines. In other embodiments of this invention, other standard component sizes, such as EIA 1206 or 0603 components, could be used.

One aspect of the programmability of components of these filter subassemblies is shown by filter subassembly 62 in FIG. 6. The same printed circuit board is used for both filter subassembly 60 and filter subassembly 62. Fewer lines or individual circuits are filtered in filter subassembly 62 and surface mount components are used only as needed. The filter subassembly 62 is intended to be representative of any of a number of assemblies in which only a portion of the lines or individual circuits, represented by pins 14 and plated through holes 38, would require capacitive filtering. With this programmable approach, unnecessary components would not be required and multiple printed circuit boards for the same connectors would not be required which would require less inventory, provide faster response time and lower cost.

Another aspect of the programmability offered by this approach is shown by the filter subassembly 64 shown in FIG. 7. In this subassembly some of the lines or pins are filtered using surface mount components 56. The remaining pins are unfiltered. However, these unfiltered pins include signal pins and ground pins.

Pins are grounded by using zero value surface mount resistors 66 between the pad 44 associated with the corresponding plated through hole 38 and an adjacent grounded surface mount pad 46. These surface mount resistors 66 can be placed using the same pick and place operation as is used to position the surface mount capacitors 56. This only requires simple reprogramming of the pick and place equipment and is amenable to large and short runs. Zero value surface mount resistors also are available in standard 0805 packages. For example, zero ohm resistors in standard 0805 packages are available as part of the Phillips Components Commercial SMD Resistors Series 9C. The length of these EIA standard 0805 rectangular chip resistors is 2.0 mm (0.080 in.) and the width is 1.2 mm (0.050 in.). Of course other sizes could be used in other embodiments. These rectangular chip zero value resistors are also positioned with the lengthwise dimension oriented parallel to the parallel through hole rows.

Figure 8:
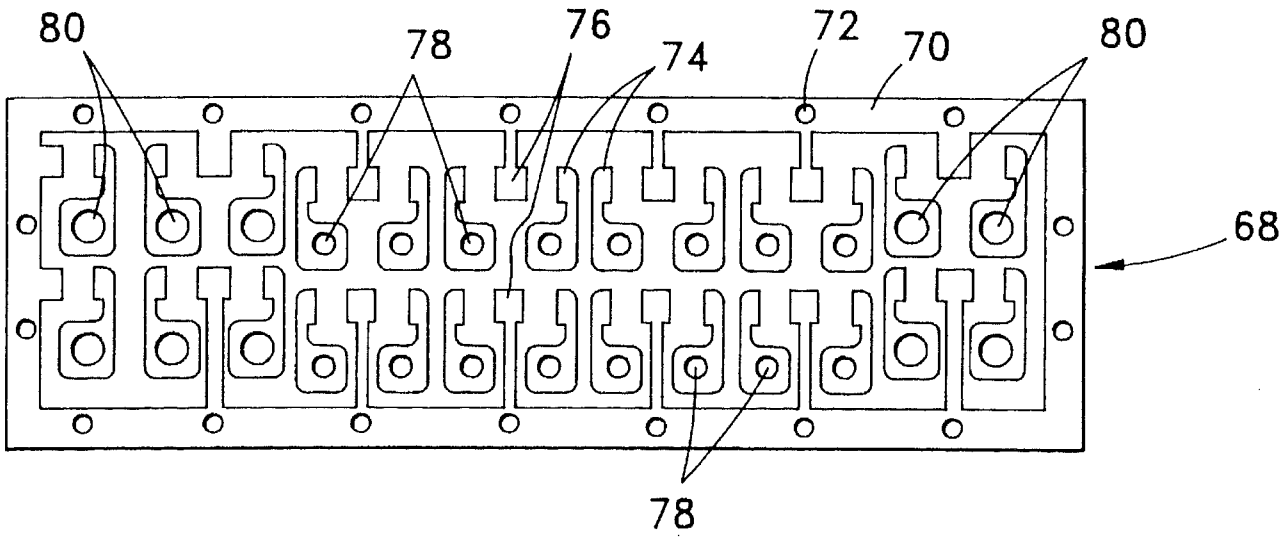
FIG. 8 is a view of the solder side of a different embodiment of a printed circuit board which is used as a filter for a connector having a different number of lines and a different configuration than that shown in FIG. 1.
Figure 9:
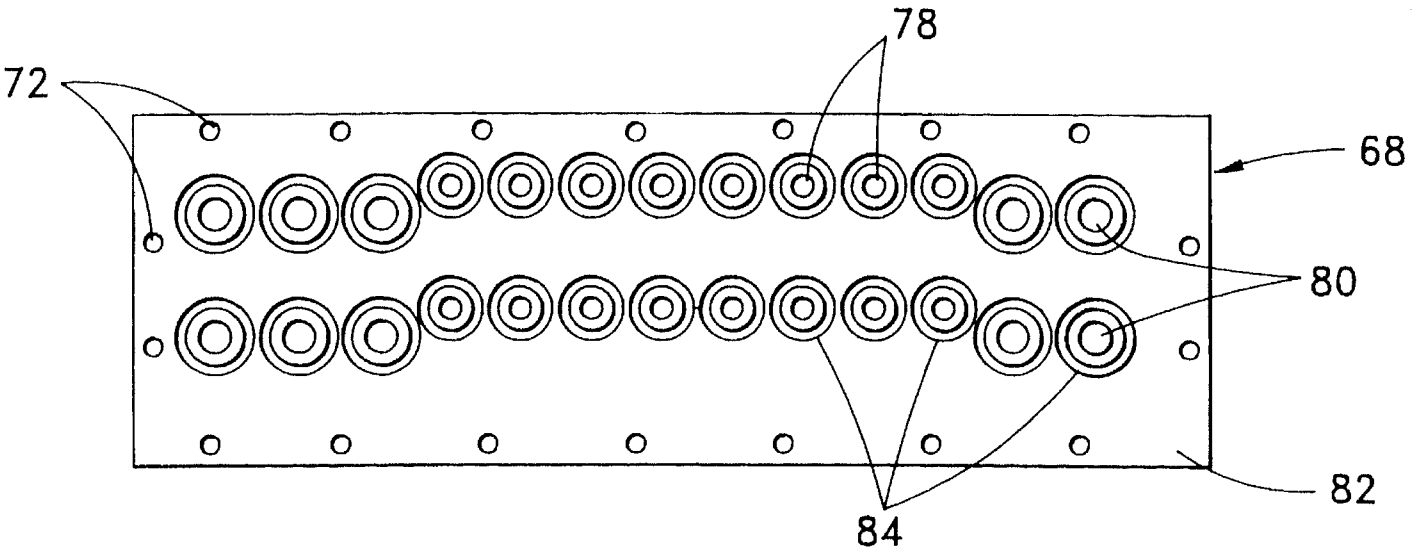
FIG. 9 is a view of the shield side of the printed board shown in FIG. 8.

The printed circuit board 16 is intended for use with a conventional twenty position header 10. A printed circuit board 68 suitable for use with a standard twenty-six position header of similar configuration is shown in FIGS. 8 and 9. This printed circuit board also has two unstaggered rows of through holes 78. Because of the configuration of the standard electrical connector header with which this printed circuit board 68 is used, slightly offset through holes 80 are located at each end of the rows of through holes 78. Printed circuit board 68 has a continuous ground strip 70 around the peripheral edge of the component side of the printed circuit board as shown in FIG. 8. Metallized connecting holes 72 extend from the ground strip 70 to the opposite side of printed circuit board 68. Surface mount pads 74 extend from each of the through holes 78 and 80, with these pads being located between the centerlines of adjacent through holes. Surface mount pads 74 associated with adjacent through holes face in opposite directions in the same manner as surface mount pads 44 for printed circuit board 16. Grounded surface mount pads 76 are located between pads 74 associated with adjacent through holes. These grounded pads 76 are connected to the ground strip 70 by traces on the component side or they are simply extensions of the ground strip 70 where the ground strip is adjacent to the through holes 80. Metallized connecting holes from the grounded surface mount pads 76 directly to the opposite side to the printed circuit board 68 are not necessary. A ground shield layer 82 covers most of the opposite side of the printed circuit board 68, and the metallized connecting holes 72 connect this layer with the ground strip 70 on the component side. The shield is etched away around the through holes 78 and 80 and solder resist 84 is applied to prevent solder bridging. Surface mount components, including capacitors and zero value resistors can be selectively mounted to this printed circuit board 68 in the same programmable manner as with the embodiment of FIGS. 1–7.

These two embodiments of the programmable filter subassemblies are representative of the many configurations which can be used with other conventional electrical connector configurations. The same programmability and dense packaging can be achieved with other connectors as well. In its broader aspects, this invention is not limited to use in shielded configurations. A single sided printed circuit board, for example containing the trace pattern of FIG. 8, could be employed to provide the filter programmability described herein. Ground could be brought to such a board by a ground pin, and a single zero value resistor could be used to maintain the ground strip and all of the grounded surface mount pads at ground potential. This invention is also not limited to use on printed circuit board headers. This programmable printed circuit board approach could also be used on wire to wire connectors, provided of course that one of the terminals used in the wire to wire connectors could be mounted in an intermediate filter printed circuit board mounted on one of the housings or an alternate way of attaching each line to the printed circuit board is employed. This invention is also not limited to the use of capacitors or zero value resistors. For example, finite value surface mount resistors could be used on this programmable printed circuit board where one line in the circuit is to be maintained at a potential other than ground. Other components, such as transient suppression devices, varistors, spark gaps, fuses or diodes could also be employed. These alternate configurations would be especially useful in applications where real estate was limited on the main printed circuit board. The filter circuit board would then provide additional space for component placement. This additional space might mean the difference between using a single sided instead of a double sided board for the main printed circuit board which would result in a lower manufacturing cost for the final product. Therefore the following claims are directed not only the representative embodiments depicted herein, but also to the other configurations to which those skilled in the art would apply this invention.

I claim:

1. An electrical connector comprising:

a dielectric housing, said housing includes a back wall with at least two apertures therein for receiving respective electrical conductors;

said electrical connector includes a back plate adjacent to said back wall, said back plate comprises an electrical transient suppression circuit for electrically interfacing with said conductors; and said back wall comprises at least two cavities therein for receiving respective surface mount components of said circuit, each said cavity encloses a respective surface mount component.

2. The electrical connector of claim 1, wherein said back wall is formed integrally of said housing.

3. The electrical connector of claim 1, wherein said back plate is fixed between said back wall and an outer cladding portion of said connector housing.

4. The electrical connector of claim 1, wherein said housing comprises an outer sheet of metal cladding for providing a portion of the path to ground of said transient suppression circuit.

5. The electrical connector of claim 4, wherein said cladding comprises a plurality of connectable shield sections.

6. The electrical connector of claim 5, wherein one of said shield sections comprises a deformable tab, said tab provides a portion of a path to ground of said transient suppression circuit.

7. The electrical connector of claim 5, wherein one of said shield sections comprises a solder tab for providing a portion of a path to ground for said transient suppression circuit.

8. The electrical connector of claim 5, wherein one of said shield sections comprises a solder tab section for providing a portion of a path to ground for said transient suppression circuit, and an opposed saddle section is provided for receiving said connector housing and the other of said shield sections.

* * * * *